US009698533B1

(12) United States Patent
Wang et al.

(10) Patent No.: US 9,698,533 B1
(45) Date of Patent: Jul. 4, 2017

(54) COMPOSITE CONNECTOR

(71) Applicant: DELTA ELECTRONICS, INC., Taoyuan (TW)

(72) Inventors: Jung-Jui Wang, Taoyuan (TW); Chia-Kai Weng, Taoyuan (TW); Li-O Lee, Taoyuan (TW); Wang-Jun He, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 15/193,473

(22) Filed: Jun. 27, 2016

(30) Foreign Application Priority Data

Apr. 8, 2016 (CN) ..... 2016 1 0217178

(51) Int. Cl.

| | |
|---|---|
| ***H01R 13/64*** | (2006.01) |
| ***H01R 12/71*** | (2011.01) |
| ***H01R 24/64*** | (2011.01) |
| *H01R 107/00* | (2006.01) |

(52) U.S. Cl.
CPC ..... *H01R 13/64* (2013.01); *H01R 12/712* (2013.01); *H01R 24/64* (2013.01); *H01R 2107/00* (2013.01)

(58) Field of Classification Search
CPC H01R 13/6397; H01R 13/4538; H01R 13/44; H01R 13/447; H01R 13/4532; H01R 13/4536; H01R 12/712; H01R 13/64; H01R 24/64; H01R 2107/00
USPC ..... 439/78, 131, 133–138, 142
See application file for complete search history.

(56) References Cited

U.S. PATENT DOCUMENTS 5,701,232 A * 12/1997 Tang ..... G06F 1/1613 174/67
5,755,821 A * 5/1998 Ngai ..... H01R 13/4532 439/138
5,793,352 A * 8/1998 Greenberg ..... G09G 5/006 345/699
7,086,879 B2 * 8/2006 Higham ..... H01R 31/06 439/137
7,466,555 B2 * 12/2008 Yamamoto ..... G06K 7/0043 361/728

(Continued)

FOREIGN PATENT DOCUMENTS

| | | |
|---|---|---|
| CN | 103474832 B | 12/2015 |
| TW | M416238 U | 11/2011 |
| TW | M453282 U | 5/2013 |

*Primary Examiner* — Tulsidas C Patel
*Assistant Examiner* — Travis Chambers
(74) *Attorney, Agent, or Firm* — Kirton McConkie; Evan R. Witt

(57) ABSTRACT

A composite connector comprises a housing, a position-limiting structure, a first type terminal, and a second type terminal. The housing is disposed on a system board, and a first oblique slot is disposed on one sidewall of the housing. The position-limiting structure is movably disposed in the housing, and the position-limiting structure and the sidewall of the housing have one of and the other of a first moving structure and the first oblique slot, respectively. The first type terminal and the second type terminal are disposed at different depths of the housing. Thereby, the space utilization of the system board is enhanced, the advantage of reducing the volume of the electronic product is achieved, and the switching operation can be more stable and less easy to fail when the connecting interfaces are switched.

11 Claims, 5 Drawing Sheets

(56) References Cited

U.S. PATENT DOCUMENTS

| | | | | |
|---|---|---|---|---|
| 7,815,450 | B1 * | 10/2010 | Chen | H01R 13/60 439/172 |
| 7,828,569 | B2 * | 11/2010 | Aronson | H01R 27/00 439/218 |
| 7,857,664 | B2 * | 12/2010 | Waryck | H01R 27/02 439/638 |
| 7,874,857 | B2 * | 1/2011 | Takei | H01R 13/64 439/218 |
| 7,946,866 | B2 * | 5/2011 | Bernstein | A61B 5/14532 439/136 |
| 8,109,793 | B2 * | 2/2012 | Faisandier | A61B 5/04325 439/630 |
| 2007/0218770 | A1 * | 9/2007 | Kikuchi | H01R 13/64 439/630 |
| 2013/0323974 | A1 * | 12/2013 | Gutierrez | H01F 5/003 439/620.15 |
| 2015/0140843 | A1 * | 5/2015 | Wu | H01R 27/02 439/142 |

* cited by examiner

COMPOSITE CONNECTOR

FIELD OF THE INVENTION

The present invention relates to a composite connector, and more particularly to a composite connector integrating two different interfaces.

BACKGROUND OF THE INVENTION

Nowadays, electronic products are very common, and connectors applied to the electronic products are produced correspondingly. With the development of science and technology, the size of the electronic product is getting smaller, so the volume of the connector also has to be reduced. In some electronic products, multiple types of connectors are disposed for supplying different transmission interfaces, which makes the connectors occupy much space in the electronic products.

Consequently, integrating multiple types of connectors to reduce the volume of the product is the direction that the industry focuses on. In the prior art, the connectors with different types of transmission interfaces are combined into one connector by stacking and then connected to the circuit board in order to reduce the occupation of space.

However, the space reduced by the stacked integration connector is limited because the stacking structure makes the height of the connector increased. Although the space utilization of the circuit board is enhanced, this kind of integration connector still occupies much space in the electronic product. The space cannot be saved effectively to achieve the reduction of volume of the electronic product.

Therefore, there is a need of providing a composite connector to solve the drawbacks in prior arts, integrate multiple types of transmission interfaces, enhance the space utilization of the circuit board, and reduce the volume of the connector, in order to save the space and achieve the advantage of reducing the volume of the electronic product.

SUMMARY OF THE INVENTION

It is an object of the present invention to provide a composite connector in order to solve the drawbacks of prior art.

The present invention provides a composite connector. By integrating two different transmission interfaces to one connector, the space of the system board occupied by the connector is reduced, and the space utilization of the system board is enhanced.

The present invention also provides a composite connector. A movable position-limiting structure is configured for switching two different transmission interfaces in order to supply different connecting plugs to connect with, such that the volume of the connector can be reduced, and the advantage of reducing the volume of the electronic product is achieved.

The present invention further provides a composite connector. A moving structure is disposed for adjusting the position of the position-limiting structure to switch two different transmission interfaces. This kind of adjusting method makes the switching operation more stable and not easy to fail when the connecting interfaces are switched.

In accordance with an aspect of the present invention, there is provided a composite connector. The composite connector comprises a housing, a position-limiting structure, a first type terminal, and a second type terminal. The housing is disposed on a system board, and a first oblique slot is disposed on one sidewall of the housing. The position-limiting structure is movably disposed in the housing, and the position-limiting structure and the sidewall of the housing have one of and the other of a first moving structure and the first oblique slot, respectively. The first type terminal and the second type terminal are disposed at different depths of the housing. When the position-limiting structure is located at a first position, a first interface is defined by the position-limiting structure and the first type terminal for electrically connecting a first connecting plug with the first interface and the system board, and when the position-limiting structure is located at a second position, a second interface is defined by the position-limiting structure and the second type terminal for electrically connecting a second connecting plug with the second interface and the system board.

In accordance with another aspect of the present invention, there is provided a composite connector. The composite connector comprises a housing, a position-limiting structure, a first type terminal, a second type terminal, and a first moving structure. The housing is disposed on a system board, the position-limiting structure is movably disposed in the housing, the first type terminal and the second type terminal are disposed relative to the position-limiting structure in the housing, and the first moving structure is connected to the position-limiting structure for adjusting the position-limiting structure to a first position and a second position. When the position-limiting structure is located at the first position, a first interface is defined by the position-limiting structure and the first type terminal for electrically connecting a first connecting plug with the first interface and the system board, and when the position-limiting structure is located at the second position, a second interface is defined by the position-limiting structure and the second type terminal for electrically connecting a second connecting plug with the second interface and the system board.

In accordance with still another aspect of the present invention, there is provided a composite connector. The composite connector comprises a housing, a position-limiting structure, a RJ terminal, and a SFP terminal. The housing comprises a connecting port and is disposed on a system board, the position-limiting structure is movably disposed in the housing, and the RJ terminal and the SFP terminal are disposed relative to the position-limiting structure in the housing. When the position-limiting structure is located at a first position, a RJ interface is defined by the position-limiting structure and the RJ terminal for electrically connecting a RJ connecting plug with the RJ interface and the system board, and when the position-limiting structure is located at a second position, a SFP interface is defined by the position-limiting structure and the SFP terminal for electrically connecting a SFP connecting plug with the SFP interface and the system board.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
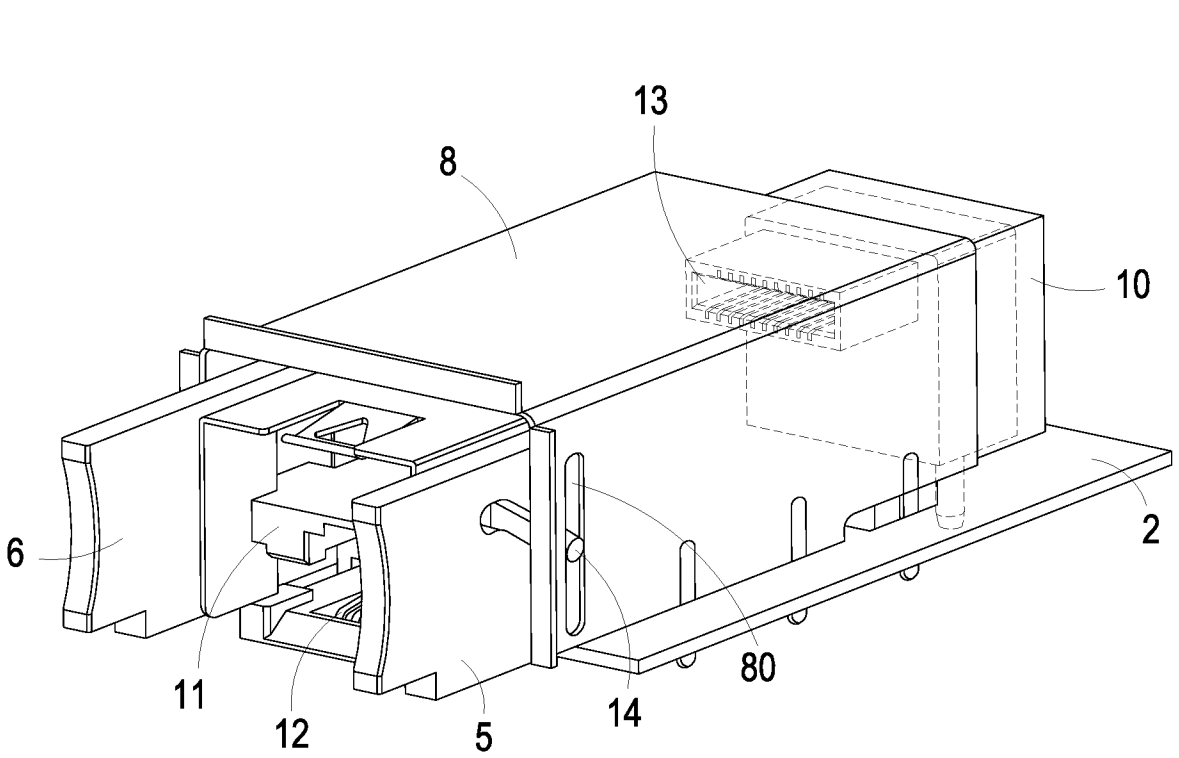
FIG. 1 schematically illustrates the structure of a composite connector according an embodiment of the present invention.
Figure 2:
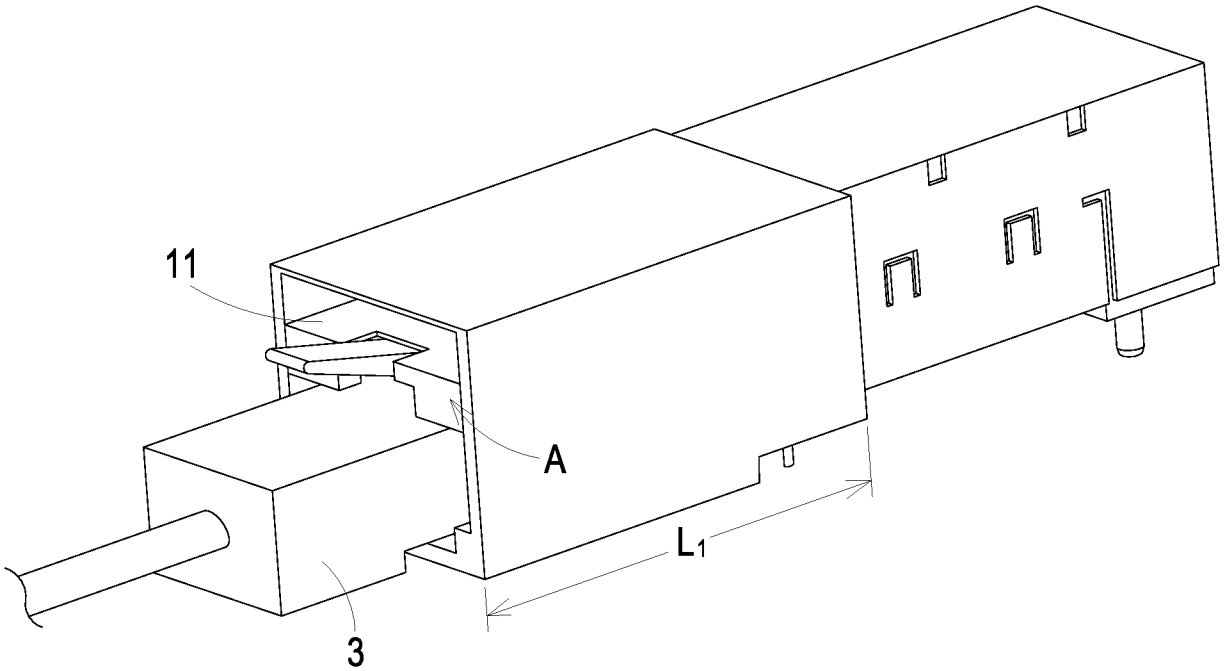
FIG. 2 schematically illustrates the partial structure of a composite connector connected with a first connecting plug according an embodiment of the present invention.
Figure 3:
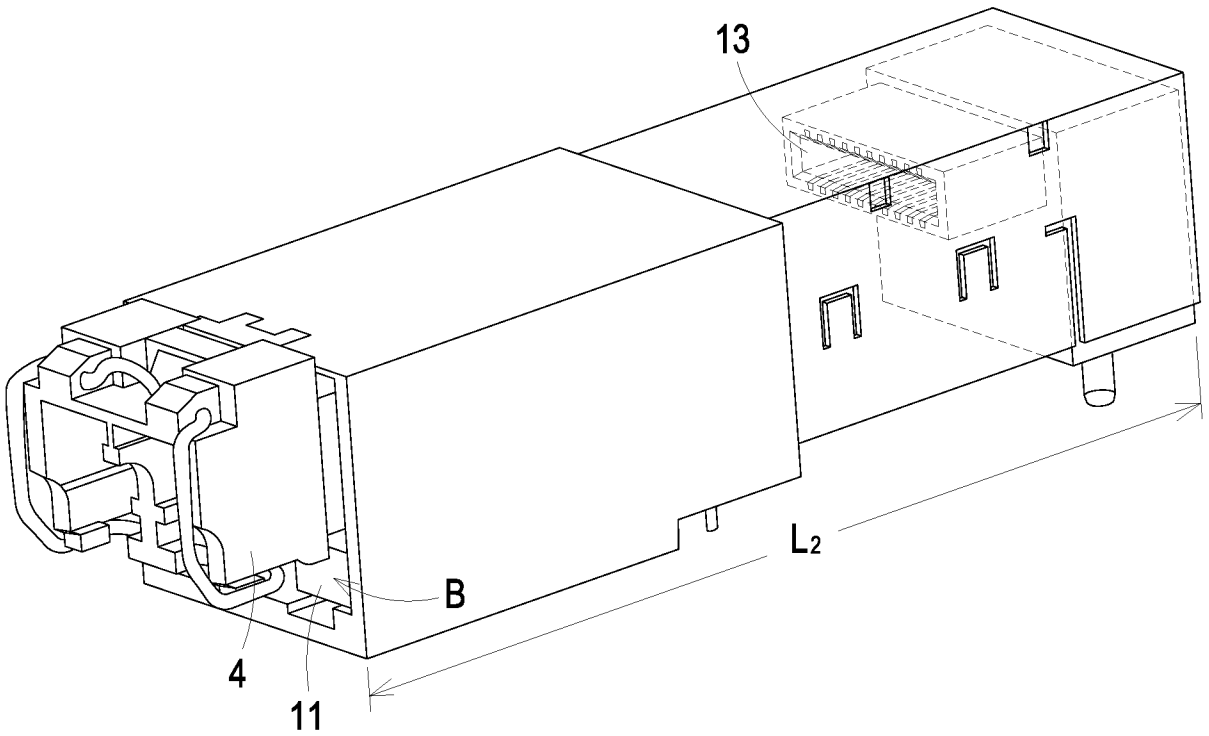
FIG. 3 schematically illustrates the partial structure of a composite connector connected with a second connecting plug according an embodiment of the present invention.

Please refer to FIG. 1, FIG. 2 and FIG. 3. FIG. 1 schematically illustrates the structure of a composite connector according an embodiment of the present invention. FIG. 2 schematically illustrates the partial structure of a composite connector connected with a first connecting plug according an embodiment of the present invention. FIG. 3 schematically illustrates the partial structure of a composite connector connected with a second connecting plug according an embodiment of the present invention. As shown in FIG. 1, FIG. 2 and FIG. 3, the composite connector 1 of the present invention comprises a housing 10, a position-limiting structure 11, a first type terminal 12, and a second type terminal 13. The housing 10 comprises a connecting port to connect with a connecting plug, and the housing 10 is disposed on a system board 2. The first type terminal 12 and the second type terminal 13 are disposed at different depths of the housing 10. The position-limiting structure 11 is movably disposed in the housing 10, and the first type terminal 12 and the second type terminal 13 are disposed relative to the position-limiting structure 11 in the housing 10, among which the position-limiting structure 11 is a partition board, but not limited herein.

When the position-limiting structure 11 is located at a first position A, a first interface is defined by the position-limiting structure 11 and the first type terminal 12 for electrically connecting a first connecting plug 3 with the first interface and the system board 2. In some embodiments, the first type terminal 12 is a RJ terminal, a SFP terminal or a USB terminal, the first interface is a RJ interface, a SFP interface or a USB interface, and the first connecting plug 3 is a RJ connecting plug, a SFP connecting plug or a USB connecting plug, but not limited herein.

When the position-limiting structure 11 is located at a second position B, a second interface is defined by the position-limiting structure 11 and the second type terminal 13 for electrically connecting a second connecting plug 4 with the second interface and the system board 2. In some embodiments, the second type terminal 13 is a RJ terminal, a SFP terminal or a USB terminal, the second interface is a RJ interface, a SFP interface or a USB interface, and the second connecting plug 4 is a RJ connecting plug, a SFP connecting plug or a USB connecting plug, but not limited thereto.

For example, the composite connector 1 of the present invention comprises a RJ terminal and a SFP terminal, among which the RJ terminal and the SFP terminal are disposed relative to the position-limiting structure 11 in the housing 10. When the position-limiting structure 11 is located at the first position A, a RJ interface is defined by the position-limiting structure 11 and the RJ terminal for electrically connecting a RJ connecting plug with the RJ interface and the system board 2, and when the position-limiting structure 11 is located at the second position B, a SFP interface is defined by the position-limiting structure and the SFP terminal for electrically connecting a SFP connecting plug with the SFP interface and the system board 2, among which the RJ interface has a first length $L_1$, and the SFP interface has a second length L7, among which the first length $L_1$ is less than the second length $L_2$.

In brief, the first interface and the second interface of the composite connector 1 of the present invention can be respectively selected from RJ interfaces, SFP interfaces and USB interfaces. Since single one connector is integrated with two different transmission interfaces, the space of the system board 2 occupied by the connector is reduced, and the space utilization of the system board is enhanced. Furthermore, the movable position-limiting structure 11 is disposed for switching two different transmission interfaces in order to supply different connecting plugs to connect with, such that the volume of the connector can be reduced, and the advantage of reducing the volume of the electronic product is achieved.

In some embodiments, the composite connector 1 further comprises at least a moving structure, which is connected with the position-limiting structure 11 for adjusting the position-limiting structure 11 to move up and down to the first position A and the second position B. In other embodiments, the composite connector 1 further comprises a turning structure, which is connected with the position-limiting structure 11 for adjusting the position-limiting structure 11 to turn to the first position A and the second position B.

Figure 4A:
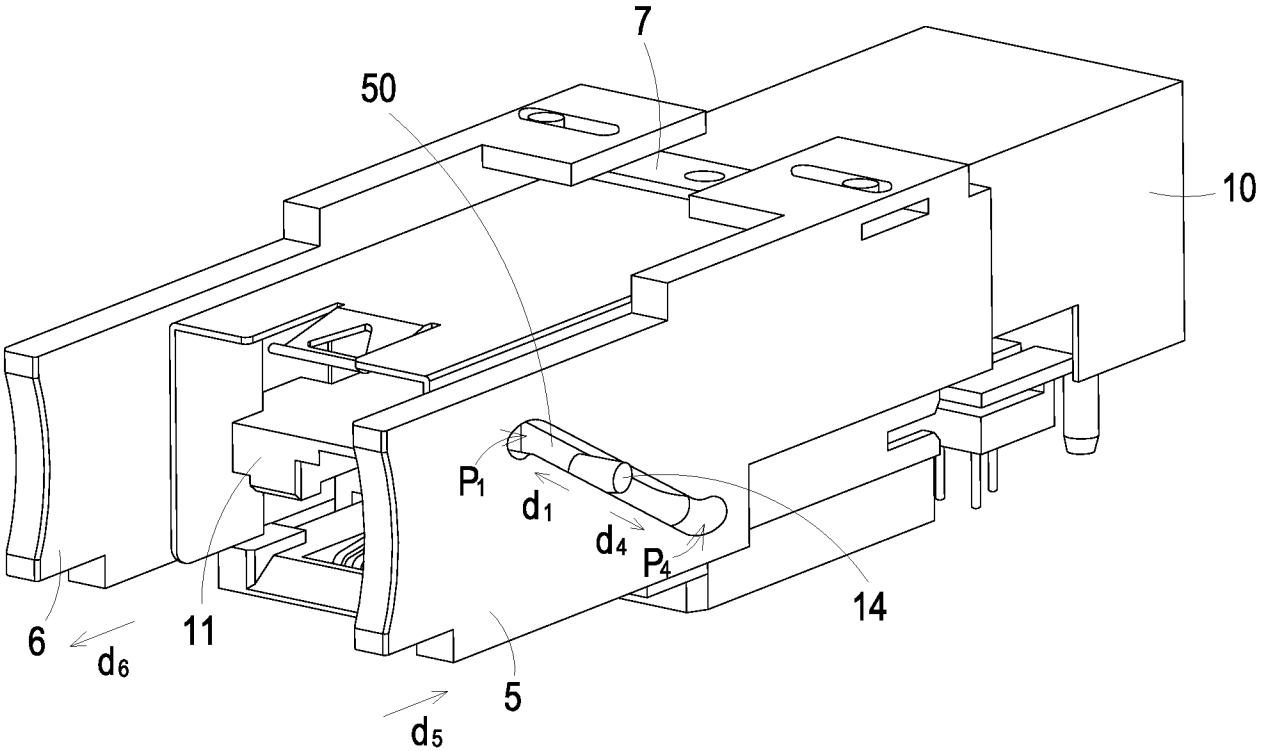
FIG. 4A schematically illustrates the side view of the partial structure of a composite connector according an embodiment of the present invention.
Figure 4B:
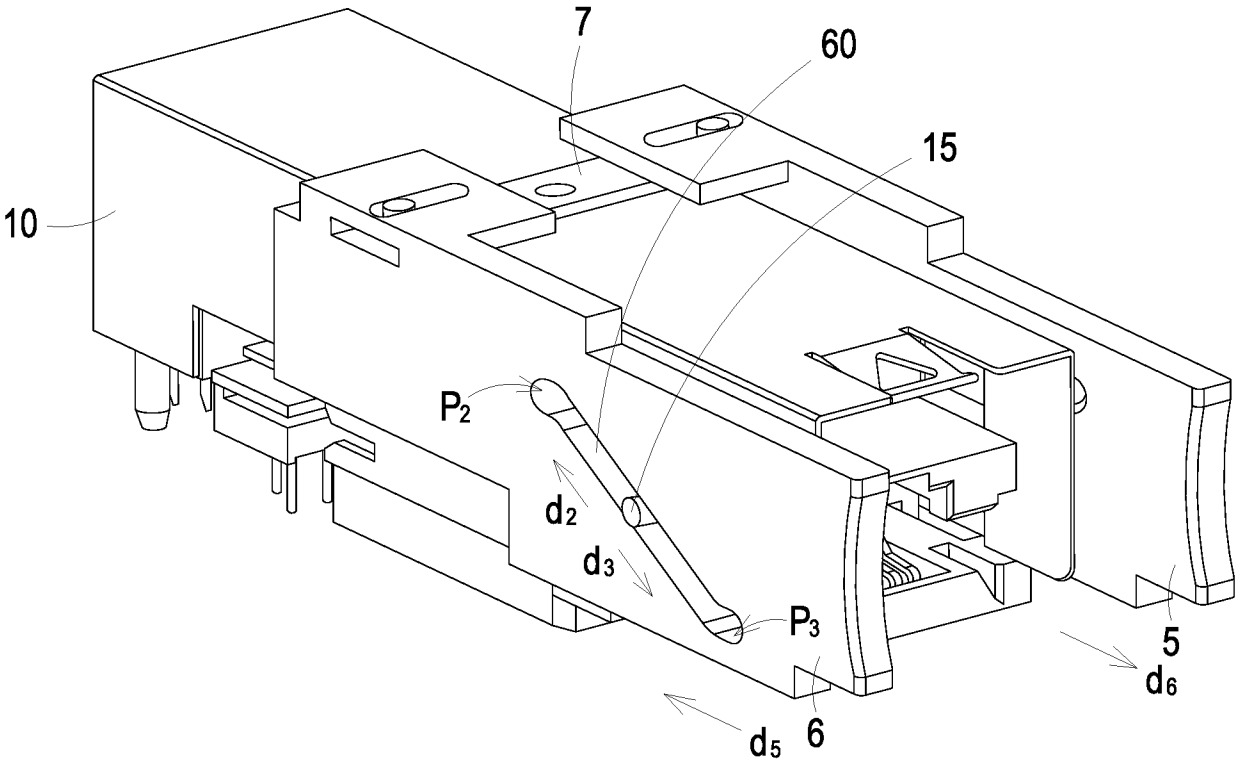
FIG. 4B schematically illustrates another side view of the partial structure of a composite connector according an embodiment of the present invention.

Please refer to FIG. 1, FIG. 4A and FIG. 4B. FIG. 4A schematically illustrates the side view of the partial structure of a composite connector according an embodiment of the present invention. FIG. 4B schematically illustrates another side view of the partial structure of a composite connector according an embodiment of the present invention. As shown in FIG. 1, FIG. 4A and FIG. 4B, the composite connector 1 of the present invention further comprises a first moving structure 14 connected to the position-limiting structure 11 for adjusting the position-limiting structure to the first position A and the second position B. According to the present invention, a first oblique 50 is disposed on one sidewall of the housing 10, or a first arm 5 is disposed on the sidewall of the housing 10, and the first oblique slot 50 is disposed on the first arm 5. The first moving structure 14 is moved at the first oblique slot 50, among which the first moving structure 14 can be a moving rod, but is not limited. Through pushing and pulling the first moving structure 14 at the first oblique slot 50, the position-limiting structure 11 can be adjusted to locate at the first position A and the second position B. In addition, the position-limiting structure 11 and the sidewall of the of the housing 10 can have one of and the other of the first moving structure 11 and the first oblique slot 50, respectively.

In some embodiments, the composite connector 1 further comprises a second moving structure 15, and a second oblique 60 is disposed on another sidewall of the housing 10, which is relative to the first arm 5, or a second arm 6 is disposed on the another sidewall of the housing 10, and the second oblique slot 60 is disposed on the second arm 6. The second moving structure 15 is moved at the second oblique slot 60, among which the first oblique slot 50 and the second oblique slot 60 are corresponded to and crossed with each other, and the position of the first arm 5 where the first oblique slot 50 is disposed is corresponding to the position of the second arm 6 where the second oblique slot 60 is disposed. In addition, the position-limiting structure 11 and the another sidewall of the of the housing 10 can have one of and the other of the second moving structure 15 and the second oblique slot 60, respectively.

The first moving structure 14 and the second moving structure 15 can be moving rods, but not limited herein. When the first moving structure 14 is moved along a first direction $d_1$ at the first oblique slot 50 to a first positioning point $P_1$, the second moving structure 15 is moved along a second direction $d_2$ at the second oblique slot 60 to a second positioning point $P_2$ for adjusting the position-limiting structure 11 to move to the first position A, and the first interface is defined by the position-limiting structure 11 and the first type terminal 12. When the second moving structure 15 is moved along a third direction $d_3$ at the second oblique slot 60 to a third positioning point $P_3$, the first moving structure 14 is moved along a fourth direction $d_4$ at the first oblique slot 50 to a fourth positioning point $P_4$ for adjusting the position-limiting structure 11 to move to the second position B, and the second interface is defined by the position-limiting structure 11 and the second type terminal 13, among which the first direction $d_1$ is opposite to the fourth direction $d_4$, and the second direction $d_2$ is opposite to the third direction $d_3$.

In some embodiments, the first arm 5 and the second arm 6 are independent structures, and are connected with each other through a connecting axle 7. By pushing the first arm 5 along a fifth direction $d_5$, the first moving structure 14 can be moved along the first direction $d_1$ at the first oblique slot 50 to the first positioning point $P_1$, and through the connecting axle 7 driving the second arm 6 to move along a sixth direction $d_6$, the second moving structure 15 is moved along the second direction $d_2$ at the second oblique slot 60 to the second positioning point $P_2$ for adjusting the position-limiting structure 11 to move to the first position A. Similarly, by pushing the second arm 6 along the fifth direction $d_5$, the second moving structure 15 is moved along the third direction $d_3$ at the second oblique slot 60 to the third positioning point $P_3$, and through the connecting axle 7 driving the first arm 5 to move along a sixth direction $d_6$, the first moving structure 14 is moved along the fourth direction $d_4$ at the first oblique slot 50 to the fourth positioning point $P_4$ for adjusting the position-limiting structure 11 to move to the second position B, among which the moved direction of the position-limiting structure 11 is perpendicular to the fifth direction $d_5$ and the sixth direction $d_6$.

In other words, the composite connector 1 of the present invention adjusts the position of the position-limiting connector 11 by moving the first moving structure 14 and the second moving structure 15 along different directions in order to switch two different transmission interfaces. This kind of adjusting method makes the switching operation more stable and not easy to fail when the connecting interfaces are switched.

Please refer to FIG. 1 again. As shown in FIG. 1, the composite connector 1 further comprises an outer housing 8. The outer housing 8 is disposed close to and around to the housing 10, the first arm 5 and the second arm 6, and a first vertical slot 80 is disposed on one sidewall of the outer housing 8. The first vertical slot 80 is disposed close to the first oblique slot 50 for restricting the first moving structure 14 to move perpendicularly at the first vertical slot 80 when the first moving structure 14 is moved at the first oblique slot 50.

In some embodiments, a second vertical slot is further disposed on another sidewall of the outer housing 8, which is relative to the sidewall where the first vertical slot 80 is disposed. The second vertical slot is corresponded to the first vertical slot 80, and the second vertical slot is disposed close to the second oblique slot 60 for restricting the second moving structure 15 to move perpendicularly at the second vertical slot 80 when the second moving structure 15 is moved at the second oblique slot 60.

Thereby, by disposing the first vertical slot and the second vertical slot, the first moving structure and the second moving structure are not easy to deviate from the path when moving.

From the above description, the present invention provides a composite connector in order to solve the drawbacks of prior art. By integrating two different transmission interfaces to one connector, the space of the system board occupied by the connector is reduced, and the space utilization of the system board is enhanced. Furthermore, a movable position-limiting structure is configured for switching two different transmission interfaces in order to supply different connecting plugs to connect with, such that the volume of the connector can be reduced, and the advantage of reducing the volume of the electronic product is achieved. Meanwhile, a moving structure is disposed for adjusting the position of the position-limiting structure to switch two different transmission interfaces. This kind of adjusting method makes the switching operation more stable and less easy to fail when the connecting interfaces are switched.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A composite connector, comprising:

a housing disposed on a system board;

a position-limiting structure movably disposed in the housing;

a first moving structure and a first oblique slot, wherein the position-limiting structure and one sidewall of the housing have one of and the other of the first moving structure and the first oblique slot, respectively;

a second oblique slot and a second moving structure, wherein the position-limiting structure and another sidewall of the housing have one of and the other of the second moving structure and the second oblique slot, respectively, and wherein the first oblique slot and the second oblique slot are corresponded to and crossed with each other;

a first type terminal; and a second type terminal, wherein the first type terminal and the second type terminal are disposed at different depths of the housing;

wherein when the position-limiting structure is located at a first position, a first interface is defined by the position-limiting structure and the first type terminal for electrically connecting a first connecting plug with the first interface and the system board, and wherein when the position-limiting structure is located at a second position, a second interface is defined by the position-limiting structure and the second type terminal for electrically connecting a second connecting plug with the second interface and the system board.

2. The composite connector according to claim 1, wherein when the first moving structure is moved along a first direction at the first oblique slot, the second moving structure is moved along a second direction at the second oblique slot, wherein when the second moving structure is moved along a third direction at the second oblique slot, the first moving structure is moved along a fourth direction at the first oblique slot, and wherein the first direction is opposite to the fourth direction, and the second direction is opposite to the third direction.

3. The composite connector according to claim 1, wherein the first interface and the second interface are respectively selected from RJ interfaces, SFP interfaces, and USB interfaces.

4. The composite connector according to claim 1, wherein the housing has a first arm, which is disposed on the sidewall of the housing, and the first moving structure or the first oblique slot is disposed on the first arm.

5. A composite connector, comprising:

a housing disposed on a system board;

a position-limiting structure movably disposed in the housing;

a first type terminal;

a second type terminal, wherein the first type terminal and the second type terminal are disposed relative to the position-limiting structure in the housing; and a first moving structure and a second moving structure connected to the position-limiting structure for adjusting the position-limiting structure to a first position and a second position;

a first oblique slot disposed on one sidewall of the housing or on a first arm, and the first moving structure is moved at the first oblique slot, a second oblique slot disposed on another sidewall of the housing or on a second arm, and the second moving structure is moved at the second oblique slot, wherein the first oblique slot and the second oblique slot are corresponded to and crossed with each other;

wherein when the position-limiting structure is located at the first position, a first interface is defined by the position-limiting structure and the first type terminal for electrically connecting a first connecting plug with the first interface and the system board, and wherein when the position-limiting structure is located at the second position, a second interface is defined by the position-limiting structure and the second type terminal for electrically connecting a second connecting plug with the second interface and the system board.

6. The composite connector according to claim 5, wherein the first arm and the second arm are independent structures.

7. The composite connector according to claim 5, wherein when the first moving structure is moved along a first direction at the first oblique slot, the second moving structure is moved along a second direction at the second oblique slot, wherein when the second moving structure is moved along a third direction at the second oblique slot, the first moving structure is moved along a fourth direction at the first oblique slot, and wherein the first direction is opposite to the fourth direction, and the second direction is opposite to the third direction.

8. The composite connector according to claim 5, wherein the first interface and the second interface are respectively selected from RJ interfaces, SFP interfaces, and USB interfaces.

9. A composite connector, comprising:

a housing comprising a connecting port and disposed on a system board;

a position-limiting structure movably disposed in the housing;

a first moving structure and a first oblique slot, wherein the position-limiting structure and one sidewall of the housing have one of and the other of the first moving structure and the first oblique slot, respectively;

a second moving structure and a second oblique slot, wherein the position-limiting structure and another sidewall of the housing have one of and the other of the second moving structure and the second oblique slot, respectively, and wherein the first oblique slot and the second oblique slot are corresponded to and crossed with each other;

a RJ terminal; and a SFP terminal, wherein the RJ terminal and the SFP terminal are disposed relative to the position-limiting structure in the housing;

wherein when the position-limiting structure is located at a first position, a RJ interface is defined by the position-limiting structure and the RJ terminal for electrically connecting a RJ connecting plug with the RJ interface and the system board, and wherein when the position-limiting structure is located at a second position, a SFP interface is defined by the position-limiting structure and the SFP terminal for electrically connecting a SFP connecting plug with the SFP interface and the system board.

10. The composite connector according to claim 9, wherein the first moving structure and the second moving structure are connected with the position-limiting structure for adjusting the position-limiting structure to move up and down to the first position and the second position.

11. The composite connector according to claim 9, wherein the RJ interface has a first length, and the SFP interface has a second length, wherein the first length is less than the second length.

* * * * *